US005326110A

United States Patent [19]

Gould

[11] Patent Number: 5,326,110

[45] Date of Patent: Jul. 5, 1994

[54] COMBINED HOLLOW CONTAINER AND DETACHABLY SECURED TOSSABLE SAUCER SHAPED DISC

[76] Inventor: John C. Gould, 3320 Glencairn Ct. Unit 101, Bonita Springs, Fla. 33923

[21] Appl. No.: 161,521

[22] Filed: Dec. 6, 1993

[51] Int. Cl.[5] ..... A63B 65/10; B65D 23/12

[52] U.S. Cl. ..... 273/424; 206/471; 206/579; 206/581; 215/100 R; 446/46; 446/74; 446/77

[58] Field of Search ..... 273/424, 425; 215/100 R; 206/461, 463, 471, 579, 581; 446/34, 46, 47, 48, 73, 74, 75, 76, 77

[56] References Cited

U.S. PATENT DOCUMENTS

| | | | |
|---|---|---|---|
| 3,272,323 | 9/1966 | Ewry | 215/100 R X |
| 3,359,678 | 12/1967 | Headrick | 273/424 X |
| 3,640,018 | 2/1972 | Light | 446/77 |
| 4,919,284 | 4/1990 | Tiedemann et al. | 215/100 R X |
| 4,973,284 | 11/1990 | Sassak | 446/48 |
| 5,116,275 | 5/1992 | Sassak | 446/48 |

*Primary Examiner*—William H. Grieb

[57] ABSTRACT

A portable hollow upright container has a vertical exposed surface. A tossable saucer shaped disc having a circular outer periphery and a concentric inner periphery is detachably secured to a member integral with the container and projecting outward from the surface.

9 Claims, No Drawings

COMBINED HOLLOW CONTAINER AND DETACHABLY SECURED TOSSABLE SAUCER SHAPED DISC

BACKGROUND OF THE INVENTION

Tossable saucer shaped discs are widely employed as amusement devices or in various types of games. These discs are often employed in this fashion in open areas such as beaches which are exposed to sunlight. Individuals who use such discs in such areas often must apply various types of fluids for protection from sun burn and these fluids are normally dispensed from portable containers.

However, individuals who wish to use discs in this manner and also need protection from sun burn may not have convenient access either to readily available discs or to readily available containers of protective fluids.

In the present invention, a container of suitable fluid is provided with a tossable saucer shaped disc readily securable to and readily detachable from the container whereby combined access to the container or the disc is quickly and conveniently available.

SUMMARY OF THE INVENTION

In accordance with the principles of this invention, a portable hollow upright container has at least a first vertical exposed surface. At least a first tossable saucer shaped disc having a circular outer periphery and a concentric inner periphery is detachably securable to the container.

To this end, there is provided at least a first member integral with the container and projecting outward from said first surface. The first member terminates in a curved generally vertical exposed surface. The exposed surface of the member has a circular outer periphery slightly smaller than the inner periphery of said first disc. The first disc is detachably securable to said first member with the inner periphery of the disc frictionally engaging the circular periphery of the exposed surface of said first member.

BRIEF DESCRIPTION OF THE DRAWINGS

FIG. 1 is a perspective exploded front view of one embodiment of the invention.

FIG. 2 is a rear view of the embodiment of FIG. 1.

FIG. 3 is a view which in solid line is a top view of the embodiment of FIGS. 1 and 2 and which in combined solid and dotted line is a top view of a second embodiment of the invention.

DETAILED DESCRIPTION OF PREFERRED EMBODIMENTS

Referring first to FIGS. 1 and 2, there is shown an upright hollow plastic container 10 lying in a vertical plane. The container typically is adapted to contain sun burn protection fluid. The container defines a shallow horizontal cylinder having a horizontal axis. The container has a rear vertical surface 12 which forms one side of the container and an opposite front vertical surface 14 forming an opposite side of the container. The container has a removable cap 16 at an upper end and a horizontal support 18 at the lower end, the support enabling the container to stand in an upright position on a suitable horizontal surface.

A plastic tossable saucer shaped disc 20 has an outer circular periphery 22 and a concentric inner circular periphery 24. The disc has an inner surface 26 having a concave curvature.

A plastic member is integral with the container and projects outwardly from the front surface. The member is provided with a horizontal cylindrical section 28 having a radius which defines a circular outer periphery only slightly smaller than the inner periphery 24 of the disc. This section has a horizontal axis coincident with the horizontal axis of the container.

The section 28 has an exposed outer surface 30 which is generally vertical but has a slightly convex curvature. This surface 30 can conform to the inner concave surface of the disc.

In use, the disc can be detachably secured to the section 28 by friction with the inner periphery of the disc engaging the outer periphery of the section and, if desired, the inner concave surface of the disc engaging the outer convex surface of the section.

In a second embodiment of the invention, as shown in FIG. 3, a second like member can be integral with the container and project outwardly from the rear vertical surface 12 of the container. The two members are identical but extend in opposite directions. The second member also has a horizontal axis coincident with the horizontal axis of the container.

A second like disc can be detachably secured to the second member in the same manner as the first disc is secured to the first member. The two discs are identical but are disposed opposite each other, with the inner surfaces of the discs facing each other.

While the invention has been described with particular reference to the drawings, the protection sought is to be limited only by the terms of the claims which follow.

What is claimed is:

1. In combination:

a portable hollow upright container having at least a first vertical exposed surface;

at least a first tossable saucer shaped disc having a circular outer periphery and a concentric inner periphery; and at least a first member integral with the container and projecting outward from said first surface, said first member terminating in a curved generally vertical exposed surface, the exposed surface of the first member having a circular outer periphery slightly smaller than the inner periphery of said first disc, said first disc being detachably securable to said first member with the inner periphery of the disc frictionally engaging the circular periphery of the exposed surface of said first member.

2. The combination of claim 1 wherein the exposed surface of the first member has a convex curvature and the first disc has an inner surface having a concave curvature, the convex and concave surfaces being frictionally engaged when the first disc is detachably secured to the first member.

3. The combination of claim 2 wherein the container is a narrow circular horizontal cylinder having a horizontal axis and the first member has a horizontal axis coincident with the horizontal axis of the cylinder.

4. The combination of claim 3 wherein the container has an upper end with a removable cap secured thereto and a lower end with a horizontal support secured thereto to enable the container to stand in vertical upright position.

5. The combination of claim 4 wherein the container has a second exposed outer vertical surface, the first and second exposed surfaces of the cylinder being parallel.

6. The combination of claim 5 further including a second like member integral with the second exposed surface of the cylinder, said second member and the second exposed surface extending in opposite direction to the first member and first exposed surface.

7. The combination of claim 6 wherein the second member has a horizontal axis coincident with the horizontal axis of the horizontal cylinder.

8. The combination of claim 7 further including a second like disc detachably securable to the second member, the first and second discs when secured to the first and second members respectively being disposed opposite to each other.

9. The combination of claim 8 wherein the material from which said container, said first and second members and said first and second discs are formed is plastic.

* * * * *